US006559079B1

(12) United States Patent
Bachner, Jr.

(10) Patent No.: US 6,559,079 B1
(45) Date of Patent: May 6, 2003

(54) THIN AND LIGHTWEIGHT BALLISTIC RESISTANT PAD WITH GROUPS OF ANGULARLY DISPLACED WOVEN SHEETS AND METHOD

(75) Inventor: Thomas E. Bachner, Jr., Eastport, MI (US)

(73) Assignee: Second Chance Body Armor, Inc., Central Lake, MI (US)

( * ) Notice: Subject to any disclaimer, the term of this patent is extended or adjusted under 35 U.S.C. 154(b) by 173 days.

(21) Appl. No.: 09/751,203

(22) Filed: Dec. 29, 2000

(51) Int. Cl.[7] ..... F41H 1/02

(52) U.S. Cl. ..... 442/246; 428/911; 89/36.05; 89/36.01; 89/36.02; 2/2.5; 442/181; 442/239

(58) Field of Search ..... 442/181, 239, 442/246; 428/911; 2/2.5; 89/36.05, 36.01, 36.02

(56) References Cited

U.S. PATENT DOCUMENTS 5,789,327 A * 8/1998 Rousseau ..... 442/135
6,127,291 A 10/2000 Coppage, Jr. et al.
6,240,557 B1 * 6/2001 Bachner, Jr. ..... 2/2.5

FOREIGN PATENT DOCUMENTS

DE WO 00/42246 * 1/2000
WO WO 00/55565 9/2000

* cited by examiner

*Primary Examiner*—Terrel Morris
*Assistant Examiner*—Jennifer Boyd
(74) *Attorney, Agent, or Firm*—Wildman, Harrold, Allen & Dixon; Thomas J. Ring

(57) ABSTRACT

A ballistic resistant pad having a first group of at least two successive overlying woven sheets constructed of high strength fibers. The warp and the weft for individual ones of the successive overlying woven sheets of the first group are substantially in alignment to one another. A second group of at least two successive overlying woven sheets constructed of high strength fibers is also provided. The warp and the weft for individual ones of the woven sheets of the second group are substantially in alignment to one another and are angularly displaced from the warp and the weft of the woven sheets of the first group.

64 Claims, 1 Drawing Sheet

10
12
14
16
14'
20N
18
14
16
16

28B
28A
20C
26B
26A 20B
24B
24A 42
42
44
46
44

20A
22B
22A 36
38
38
40
46
45°
38
38
38
34
90°

THIN AND LIGHTWEIGHT BALLISTIC RESISTANT PAD WITH GROUPS OF ANGULARLY DISPLACED WOVEN SHEETS AND METHOD

FIELD OF THE INVENTION

The present invention relates to protective garments for resisting ballistic forces and more particularly to ballistic resistant pads constructed with layered woven sheets utilized in body armor protective garments.

BACKGROUND OF THE INVENTION

In the evolution of protective garments, there has been an ever pressing desire to develop stronger, lighter, thinner, cooler, more breathable and thereby more wearable garments. Such garments are intended to resist certain potentially lethal forces such as those from gun shots. Typically, these garments are designed to protect the wearer from ballistic forces by preventing penetration through the garment from a projectile bullet.

Attempts at developing thin, light, flexible and breathable and more wearable protective body armor have been made in order to create garments that are more wearable to the user. The more light, thin and less insulating the protective ballistic resistant garment is, the more likely the user (such as a law enforcement officer) will actually wear the garment, especially during the long hours of a working shift.

It is also desirable to have the protective body armor garment cover as much of the wearer's torso as possible while also maintaining wearability. The thinner and lighter the protective article, the more coverage can be offered. Concealability of the anti-ballistic body armor may also be improved if it is constructed to be thin and non-bulky. These attempts at developing thin and lightweight ballistic resistant body armor articles have also been made to try to allow increased freedom of movement and mobility so that the user wearing the article is not hampered from doing his or her job.

These attempts at reducing weight while improving the thinness of the article have previously been made by the utilization of layers of woven sheets of aramid fibers. High tensile strength aramid fibers such as Kevlar® produced by E. I. DuPont de Nemours & Company of Wilmington, Del., have often been employed in forming the woven ballistic fabric. Aramids such as Twaron® T-1000 and Twaron® T-2000/T-2040 of Accordis Fibers, Inc. have also been used in forming woven sheets of material in ballistic resistant pads. Recently, high performance rigid-rod lyotropic liquid crystal polymer fiber formed from poly (p-phenylene-2, 6-benzobisoxazole) (PBO) developed by Toyobo Co. Ltd. and sold under the name Zylon® has been used in body armor products. Thus, there has been an ongoing need to construct ballistic resistant pads which have improved wearability through the employment of thinner, lighter more flexible and higher strength materials.

Various voluntary governmental ballistic standards have been established to certify certain ballistic resistant garments. The tests determine the ability of the garment to resist penetration and also measure backface signature resulting from various ballistic rounds shot from various types of weapons. In particular, the National Institute of Justice (NIJ) Standard 0101.03 and 0101.04 certification tests are ballistics tests for certifying certain body armor products. Both the NIJ Standard 0101.03 and 0101.04 tests are grouped into different Threat Levels, with each Threat Level corresponding to ballistic projectile penetration stopping capabilities of various ballistic rounds fired from designated weapons. The different Threat Levels have defined criteria for defeating certain ballistic rounds and number of rounds fired as well as defined backface signature requirements. For generally concealable type ballistic resistant body armor NIJ Standard certification tests are often performed for NIJ Threat Levels IIA, II and IIIA. NIJ Threat Level IIIA is a higher standard level than NIJ Threat Level II and which in turn is a higher standard level than NIJ Threat Level IIA. There is therefore a need to provide thin and lightweight protective body armor garments having low insulating properties and good moisture vapor breathability to increase wearability, and which also meet ballistic certification tests.

SUMMARY OF THE INVENTION

It is an object of the invention to address one or more of the above referenced needs by providing a ballistic resistant pad which is thin and lightweight.

DETAILED DESCRIPTION

Stated generally, a ballistic resistant pad is provided with a first group of at least two successive overlying woven sheets constructed of high strength fibers with the warp and the weft for individual ones of the successive overlying woven sheets of the first group being substantially in alignment to one another. A second group of at least two other successive overlying woven sheets constructed of high strength fibers is also provided in which the warp and the weft for the individual ones of the woven sheets of the second group are substantially in alignment to one another and are angularly displaced from the warp and the weft of the woven sheets of the first group. The first and second groups of successive overlying woven sheets of the pad are positioned adjacent to one another. The groups may have an equal number of successive overlying sheets selectively ranging from two to five successive overlying sheets in each group. The angular displacement between the warp and the weft of the successive overlying woven sheets of the first group relative to the warp and the weft of the successive overlying woven sheets of the second group may selectively range from 22.5 degrees to 45 degrees.

The ballistic resistant pad has a third group positioned adjacent to the second group with the third group having at least two successive overlying woven sheets of high strength fibers. The warp and the weft for individual ones of the woven sheets of the third group are substantially in alignment to one another and are angularly displaced relative to the warp and the weft of the woven sheets of the second group. The warp and the weft of the overlying woven sheets within the third group are substantially in alignment with the warp and the weft of the overlying woven sheets within the first group. This pattern may selectively be repeated for each of the subsequent adjacent groups of sheets of the pad such that the warp and the weft of the successive overlying woven sheets of every other group (i.e., alternating groups: first, third, fifth, etc. and second, fourth, sixth, etc.) are substantially in alignment to one another.

Figures 1, 2, 3, 4, 5:
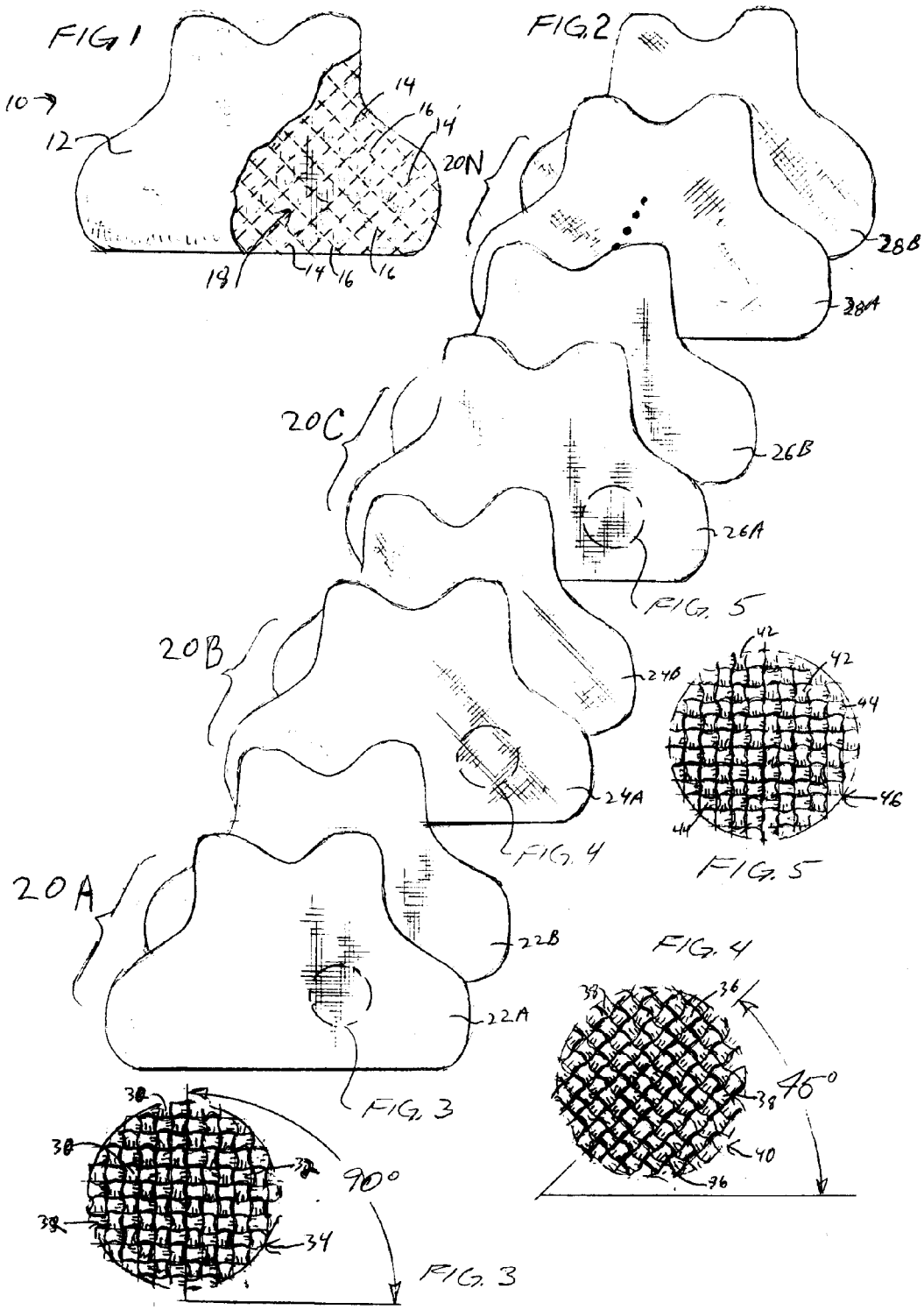
FIG. 1 is a front view of a ballistic resistant pad with a pad cover partially broken away.
FIG. 2 is an exploded view illustrating groups of overlying woven sheets of the ballistic resistant pad without stitching being shown.
FIG. 3 is an enlarged view of a weave of high strength fibers for a group of overlying woven sheets seen at the circle identified as FIG. 3 in FIG. 2.
FIG. 4 is an enlarged view of a weave of high strength fibers for a group of overlying woven sheets seen at the circle identified as FIG. 4 in FIG. 2.
FIG. 5 is an enlarged view of a weave of high strength fibers for a group of overlying woven sheets seen at the circle identified as FIG. 5 in FIG. 2.
Figure 1:
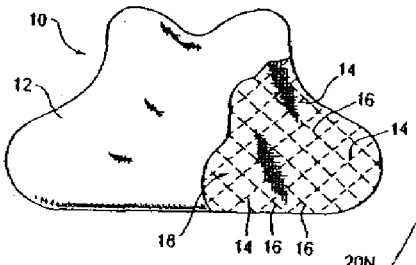
Figure 2:
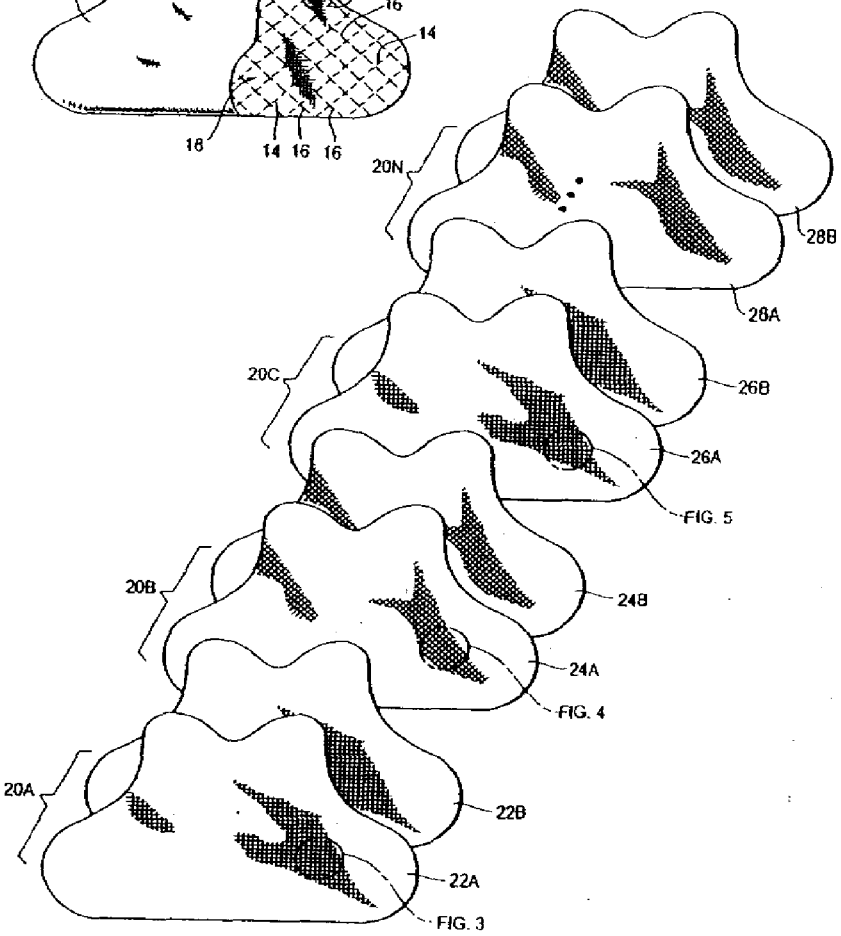
Figure 3:
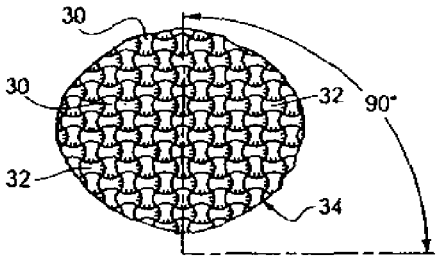
Figure 4:
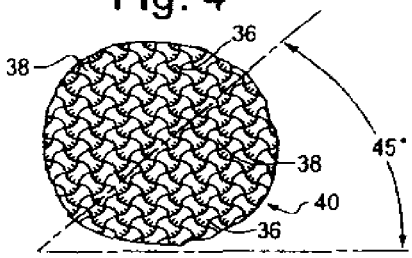
Figure 5:
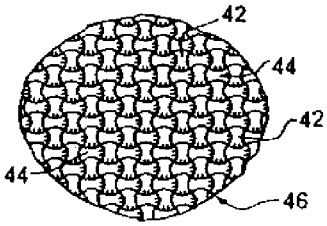

Referring to FIG. 1, ballistic resistant pad 10 with associated pad cover 12 is shown. As will be discussed in further detail with reference to FIGS. 2–5, the ballistic resistant pad 10 has multiple successive groups of overlying woven sheets constructed of high strength fibers. The individual successive groups each have a plurality of at least two successive overlying woven sheets with the warps and wefts of the successive overlying woven sheets being substantially in alignment to one another. The warps and the wefts of the woven sheets in one group are angularly displaced from the respective warps and the wefts of the woven sheets of the next adjacent successive group of sheets in the pad.

"As seen in FIG. 1, the overlying woven sheets for every one of the groups of sheets are all stitched together with rows of stitches 14 generally aligned in one direction (such as a 45° angle) and with rows of stitches 16 generally aligned in another direction (such as at a −45° angle) forming a quilt stitch pattern 18 for securing together the sheets of the ballistic resistant pad 10. The multiple rows of stitches 14, 16 in the quilt stitch pattern 18 securing together the groups of overlying sheets of the pad 10 may selectively be formed of an aramid thread. The rows of stitches 14 aligned in the one direction of the quilt pattern 18 are selectively spaced 1.0 to 4.25 inches apart from each other. The other rows of stitches 16 aligned in the other direction of the quilt stitch pattern 18 are also selectively spaced approximately 1.0 to 4.25 inches apart from one another. The individual rows of stitches 14, 16 in both directions may selectively employ approximately four stitches per inch to secure together the sheets of the pad 10. Thus, it will be understood that the quilt stitch pattern 18 of FIG. 1 is not drawn to scale but is illustrative of an exemplary quilt stitch pattern for a ballistic resistant pad. It will also be appreciated that if the pad cover of FIG. 1 were removed, it would be seen that the quilt stitch pattern 18 extends throughout the entire pad. A box stitch pattern formed from crossing rows of stitches of aramid thread with one set of rows aligned in a substantially vertical direction (at 90°) and another set of rows aligned in a substantially horizontal direction (at 0°) may selectively be used to secure together the groups of overlying sheets of the pad as well as other known stitch patterns in the art."

The high strength fibers employed in the overlying woven sheets in the groups of sheets of the pad 10 are poly(p-phenylene-2, 6-benzobisoxazole) (PBO) fibers such as those sold under the trademark name Zylon® by Toyobo Co., Ltd. of Osaka, Japan. The PBO fibers may selectively be up to 1000 denier and 1.5 dpf (denier per filament) fibers. The high strength fibers in the overlying woven sheets of the pad 10 may alternatively be poly (paraphenylene-terephthalamide) aramid fibers such as Twaron® T-2040/T-2000 (microfilament fibers) or T-1000 fibers manufactured by Accordis Fibers, Inc. Aramid fibers sold under the trademark name Kevlar® by E. I. DuPont de Nemours & Company of Wilmington, Del. may also be employed. The aramid fibers may selectively be up to 3000 denier and up to 1.5 dpf fibers. To protect the pad 10 from outer elements, and body oils and salts, pad cover 12 is constructed at least in part of a waterproof oleophobic and moisture vapor permeable material, such as GORE-TEX®, for covering and enclosing the groups of successive overlying woven sheets of the pad 10. Pad cover 12 may alternatively utilize Supplex®, a highly breathable material formed from nylon and treated with dynamic water repellant which is made by E. I. DuPont de Nemours & Company. Other covering materials may selectively be used such as rip stop nylon.

Referring now to FIG. 2, an exploded view of the multiple groups 20A–N of successive overlying woven sheets 22A, 22B, 24A, 24B, 26A, 26B, 28A, 28B is shown. In the embodiment of FIG. 2, each group 20A–N has two successive overlying woven sheets constructed of high strength fibers. As will be explained in further detail with reference to FIGS. 3–5, each of the successive overlying sheets 22A, 22B, 24A, 24B, 26A, 26B, 28A, 28B associated with a corresponding group has the high strength warp fibers and the high strength weft fibers for the sheets in the group all being substantially in alignment to one another. For instance, the two successive overlying sheets 22A, 22B of group 20A have the warp 30 and the weft 32 (FIG. 3) for the weave 34 of both sheets being aligned with one another. Both the two successive overlying woven sheets 24A, 24B of group 20B have their respective warps 36 and wefts 38 (FIG. 4) for the weave 40 substantially in alignment to one another. Both the successive overlying woven sheets 26A, 26B of group 20C also have their respective warps 42 and wefts 44 (FIG. 5) of weave 46 substantially in alignment to one another. It will be appreciated that group 20N having overlying woven sheets 28A, 28B is merely a representation to demonstrate that various numbers of groups may be selectively employed for various embodiments of the pad.

Group 20A is positioned adjacent to group 20B and group 20B is positioned adjacent to group 20C with this pattern repeating throughout the groups 20A–N for the entire pad 10. The individual successive overlying woven sheets 22A, 22B, 24A, 24B, 26A, 26B, 28A, 28B in the groups 20A–N have a weight which selectively ranges from 3.0 to 6.0 ounces per square yard (oz/yd$^2$) and a thickness ranging from 0.005 to 0.011 inches. In one embodiment, the high strength warp and weft fibers of the woven sheets in groups 20A–N are woven in a plain weave of 25×24 PBO fibers per inch with the individual sheets 22A, 22B, 24A, 24B, 26A, 26B, 28A, 28B having a weight of 3.2 oz/yd$^2$ and a thickness of 0.0063 inches. An equal number of successive overlying sheets may selectively be employed in the respective groups 20A–N. Although, two successive overlying woven sheets per group are seen in the embodiment of FIG. 2, alternative equal numbers of sheets having aligned warps and wefts in corresponding groups may selectively be employed. For instance, the groups 20A–N may each selectively employ three, four, five or more successive overlying woven sheets with each individual group having all the weaves of its associated sheets aligned with one another.

Referring now to FIGS. 2–5, angular displacement between the warps and the wefts of the overlying sheets of one group relative to the warps and wefts of the overlying sheets of an adjacent group in the pad is shown. As seen in FIGS. 2 and 3, group 20A has two successive overlying woven sheets 22A, 22B, FIG. 2, constructed of a weave 34 of high strength fibers 30, 32, in which the warp 30 and the weft 32, FIG. 3, for the individual successive overlying woven sheets 22A, 22B of group 20A are in alignment to one another. The overlying sheets 22A, 22B in group 20A are woven in a plain weave 34 with the warp fibers 30 in a generally vertical direction and the weft fibers 32 crossing at a 90° angle in a generally horizontal direction with the sheets 22A, 22B placed in position for manufacture of the pad 10. As seen in FIGS. 2 and 4, group 20B has two successive overlying woven sheets 24A, 24B, FIG. 2, constructed of a weave 40 of high strength fibers 36, 38 in which the warp 36 and the weft 38, FIG. 4, for the individual sheets 24A, 24B of group 20B are in alignment with one another but are angularly displaced from the warp 30 and weft 32 of the woven sheets 22A, 22B of group 20A. The woven sheets 24A, 24B of group 20B are positioned such that the warp 36 and weft 38 of woven sheets 24A, 24B are angularly displaced at 45 degrees relative to the warp 30 and weft 32 positioning of woven sheets 22A, 22B of group 20A. The successive overlying woven sheets 24A, 24B of group 20B are also woven in a plain weave 40 with the warp fibers 36 positioned generally at a 45° angle and the weft fibers 38 crossing at a 90° angle and being positioned generally at a −45° angle. The woven sheets 24A, 24B of group 20B are placed adjacent to the woven sheets 22A, 22B of group 20A such that woven sheet 22B is positioned against sheet 24A.

As seen in FIGS. 2 and 5, group 20C is positioned adjacent to group 20B and has two successive overlying woven sheets 26A, 26B, FIG. 2, constructed of a weave 46 of high strength fibers 42, 44 in which the warp 42 and the weft 44, FIG. 5, for the individual successive overlying woven sheets 26A, 26B of group 20C are in alignment to one another but are angularly displaced relative to the warp 36 and the weft 38 of the woven sheets 24A, 24B of group 20B. As seen in FIGS. 3 and 5, the warp 42 and the weft 44 of the overlying woven sheets 26A, 26B within group 20C are positioned to be in alignment with the warp 30 and the weft 32 of the overlying woven sheets 22A, 22B within group 20A. Like the successive overlying woven sheets 22A, 22B of group 20A, the successive overlying woven sheets 26A, 26B of group 20C are positioned adjacent to the group 20B and are woven in a plain weave 46 with the warp fibers 42 in a generally vertical direction and the weft fibers 44 crossing at a 90° angle in a generally horizontal direction with the sheets 26A, 26B placed in position for manufacture of the pad 10.

In this embodiment, the warp and weft orientation the sheets 26A, 26B of group 20C relative to the warp and weft orientation of the sheets of group 20B is generally the same as the warp/weft orientation of the sheets in group 20A relative to the warp/weft orientation of the sheets 24A, 24B in group 20B. The woven sheets 24A, 24B of group 20B are positioned such that the warp 36 and weft 38 of the woven sheets 24A, 24B are angularly displaced at 45 degrees relative to the warp 42 and weft 44 positioning of the woven sheets 26A, 26B of group 20C. In the embodiment as seen in FIGS. 2–5, this pattern of warp/weft angular displacement of sheet groups repeats for all the groups 20A–N of the pad 10. One group of sheets will have, for example, 90° orientation, FIG. 3, (in which the warp fibers are placed at 90° from horizontal), the next adjacent group of sheets will be angularly displaced and will have, for example, a 45° orientation, FIG. 4, (in which the warp fibers are placed at 45° from horizontal), and the next adjacent group of sheets thereafter will be positioned in the 90° orientation followed by another group of sheets positioned in the 45° orientation with this pattern of warp/weft angular displacement between subsequent groups of sheets repeating for all of the groups comprising the ballistic resistant pad. Thus, in this embodiment, the warp and weft of the successive overlying sheets of every other group, within the successive groups of the pad, are substantially in alignment with one another. By positioning the warp and weft arrangements at different angles, the number of directions for the dispersion of energy are increased upon a ballistic impact to the sheets of the pad. This increases the blunt trauma impact resistance performance of the pad. Advantageously, fewer woven sheets may then be utilized for a pad to meet various stopping capability requirements thereby providing thinner and more lightweight ballistic resistant pads while maintaining acceptable performance results. Additionally, by utilizing two or more woven sheets per group, production in manufacturing is increased over angularly displacing the woven sheets one sheet at time when building a vest.

Although, the warp and weft angular displacement between the successive groups shown in the embodiment in FIGS. 2–5 amounted to a 45 degree displacement, the angular displacement between the warp fibers and the weft fibers of the successive overlying woven sheets of one group relative to the warp fibers and the weft fibers of the successive overlying woven sheets of another group (such as the sheets of the next adjacent successive group) may selectively range from 22.5 degrees to 45 degrees. Additionally, the angular displacement may selectively vary between successive groups of the pad. For instance, in alternative embodiments, the warp/weft angular displacement between two groups of sheets may be 22.5 degrees, the warp/weft angular displacement between the next two groups may be 30 degrees, followed by a warp/weft angular displacement between the next subsequent groups selectively being at 45 degrees with various patterns of warp/weft angular displacement between sheets of separate groups following thereafter. Varying angles of warp/weft angular displacement and varying patterns of the angular displacement between the groups of woven sheets comprising the ballistic resistant pad may selectively be employed. For example, in different embodiments, two or more non-adjacent groups of multiple sheets may have their respective warps and wefts aligned with one another or alternatively, all the groups of multiple sheets may selectively have their respective warps and wefts angularly displaced from one another.

Thin and lightweight ballistic resistant pads have been constructed which meet the level of protection required under both National Institute of Justice (NIJ) Standard 0101.03 and 0101.04 for Threat Level IIA, Threat Level II and Threat Level IIIA. The pads meeting Threat Levels IIA, II and IIIA for NIJ Standards 0101.03 and 0101.04 used sheets of woven poly (p-phenylene-2, 6-benzobisoxazole) (PBO) fibers woven in a 25 warp×24 weft fibers per inch plain weave. Alternative numbers of warp fibers and weft fibers per inch in the weave may selectively be employed. The individual woven sheets have a weight which range from approximately 3.0–3.4 oz/yd$^2$ and a thickness ranging from 0.0055 to 0.0075 inches. For instance, in certain embodiments, woven sheets having a weight of approximately 3.2 oz/yd$^2$ and a thickness of approximately 0.0063 inches may selectively be employed. For each of the pads, two successive overlying sheets of woven PBO fiber were used per group and followed the warp/weft arrangement seen and described in FIGS. 2–5. Alternating groups of two successive overlying woven sheets were employed such that one group positioned the weave for the sheets in the orientation seen in FIG. 3 (i.e. warp fibers vertically positioned at 90° from horizontal and weft fibers horizontally positioned at 0°) and the next adjacent group had the weave for the sheets angularly displaced by 45° relative to the one group as seen in the orientation of FIG. 4 (i.e. warp fibers positioned at 45° from horizontal and weft fibers positioned at −45° from horizontal). The successive adjacent groups each having two sheets of woven PBO fiber alternated between the orientation seen in FIG. 3 and the orientation seen in FIG. 4 throughout each of the pads meeting Threat Levels IIA, II and IIIA.

The warp and the weft of the successive overlying woven sheets of every other group (i.e. first, third, fifth, etc.; second, fourth, sixth, etc.) were positioned to be aligned with one another. For example, two woven sheets are positioned having the weave orientation of FIG. 3; then two more woven sheets are positioned having the weave orientation of FIG. 4; two more woven sheets are positioned having the orientation of FIG. 3 (or FIG. 5); then two more woven sheets are positioned having the weave orientation of FIG. 4 with this pattern repeating throughout the groups for each pad meeting the different Threat Levels. The groups of woven sheets are stacked one after another, with one pair of sheets turned to angularly displace the weaves of the sheets relative to the underlying weaves of the previously positioned pair of sheets and repeating the pattern of angular displacement when stacking the sheet groups to form the pad. Ballistic resistant pads may selectively employ individual sheets having a relatively higher weight and areal density, within the range, and incorporate a relatively lower total number of sheets in an effort to meet backface signature requirements for pads under NIJ 0101.04. Alternatively, if a higher number of sheets each having a relatively lower weight and areal density were used to satisfy the 0101.04 Standard, utilization of pad stiffening techniques known in the art, such as a higher concentration of connective stitching through the sheets of the pad, may selectively be employed. Once a sufficient number of groups of sheets are overlied in position, the sheets are cut into the desired form for the pad. The groups of successive overlying woven sheets are quilt stitched with rows of stitches of aramid thread in one direction each spaced approximately 1.25 inches apart and rows of stitches of aramid thread in a crossing direction each spaced approximately 1.25 inches apart. The quilt stitched groups of woven sheets of the pad are then placed in a GORE-TEX® ComfortCOOL® pad cover.

The ballistic resistant pad meeting the level of protection under NIJ Standards 0101.03 ("03") and 0101.04 ("04") for Threat Level IIA advantageously has an areal density not greater than 0.47 pounds per square foot (lbs/ft$^2$) and a thickness not greater than 0.13 inches. As will be appreciated by those skilled in the art, NIJ Standard 0101.04 for Threat Level IIA involves testing body armor against 9 millimeter (mm) 124 grain full metal jacket (FMJ) projectile at 1120 feet per second (fps) and 0.40 Smith & Wesson, 180 grain full metal jacket projectile at 1055 fps. As will also be appreciated by those skilled in the art, NIJ Standard 0101.03 certification testing for Threat Level IIA involves a 0.357 Magnum, 158 grain jacketed soft point (JSP) projectile at 1,250 feet per second (fps) and a 9 mm, 124 grain FMJ round nose (RN) projectile at 1090 fps.

The ballistic resistant pad meeting the 04 and 03 criteria for Threat Level IIA may include from sixteen to twenty-four woven sheets forming from eight to twelve successive groups which overlie one another and in which each group within the nine to eleven successive groups has two successive overlying woven sheets. For instance, ten successive groups each having two overlying woven sheets may be employed. The warp and the weft of each of the two successive overlying sheets within the individual groups (eight to twelve groups) are substantially in alignment to one another. Because the weaves in the sheets in the successive groups are angularly displaced by 45 degrees as seen in FIGS. 3–5, the warp and weft of the woven sheets within any two adjacent successive groups in the pad are angularly displaced by 45 degrees relative to one another. The angular displacement of the warp and weft for the woven sheets of one group relative to the warp and weft for the woven sheets within an adjacent successive group may selectively range from 22.5 degrees to 45 degrees. Additionally, every other group, within the successive groups (ranging from eight to twelve groups), for the Threat Level IIA ballistic resistant pad, has the warp and the weft for the overlying woven sheets (of every other group) positioned to be aligned with one another.

The ballistic resistant pad meeting the level of protection under NIJ Standards 0101.03 and 0101.04 for Threat Level II advantageously has an areal density not greater than 0.56 lbs/ft$^2$ and a thickness not greater than 0.16 inches. As will be appreciated by those skilled in the art, NU Standard 0101.04 for Threat Level II involves testing body armor against 9 mm, 124 grain full metal jacket projectile at 1205 fps and 0.357 Magnum, 158 grain semi jacketed hollow point projectile at 1430 fps. As will also be appreciated, NIJ Standard 0101.03 Certification Testing for Threat Level II involves a 0.357 Magnum, 158 grain JSP projectile at 1,395 fps and a 9 mm, 124 grain FMJ projectile at 1175 fps.

The ballistic resistant pad meeting the 04 and 03 test criteria for Threat Level II may include from twenty to twenty-eight woven sheets forming from ten to fourteen successive groups which overlie one another and in which each group within the ten to fourteen successive groups has two successive overlying woven sheets. For instance, twelve successive groups each having two overlying woven sheets may be employed. The warp and the weft of each of the two successive overlying sheets within the individual groups (ten to fourteen groups) are substantially in alignment to one another. In the ballistic resistant pad, the warp and weft of the woven sheets within any two adjacent successive groups in the pad are angularly displaced by 45 degrees relative to one another. The angular displacement of the warp and weft for the successive overlying woven sheets of one group relative to the warp and weft for the successive overlying woven sheets within an adjacent successive group may selectively range from 22.5 to 45 degrees. Additionally, within the ten to fourteen successive groups, for the Threat Level II ballistic resistant pad, the warp and the weft for the overlying woven sheets of every other group are positioned to be aligned with one another.

The ballistic resistant pad meeting the level of protection under NIJ Standards 0101.03 and 0101.04 for Threat Level IIIA advantageously has an areal density not greater than 0.72 lbs/ft$^2$ and a thickness not greater than 0.20 inches. As will be appreciated by those skilled in the art, NIJ Standard 0101.04 for Threat Level IIIA involves testing body armor against 9 mm SMG (sub-machine gun), 124 grain full metal jacket projectile at 1430 feet per second (fps) and 0.44 Magnum, 240 grain jacketed hollow point projectile at 1430 fps. As will also be appreciated, NU Standard 0101.03 Certification Testing for Threat Level IIIA involves a 0.44 Magnum, 240 grain SWC-GC (semi-wad cutter-gas checked) projectile at 1400 feet per second (fps) and a 9 mm, 124 grain FMJ projectile at 1400 fps.

The ballistic resistant pad meeting the 04 and 03 test criteria for Threat Level IIIA includes twenty-six to thirty-four woven sheets forming from thirteen to seventeen successive groups which overlie one another and in which each group within the thirteen to seventeen successive groups has two successive overlying woven sheets. For instance, fifteen successive groups each having two overlying woven sheets may be employed. The warp and the weft of each of the two successive overlying sheets within the individual groups (thirteen to seventeen groups) are substantially in alignment to one another. In the ballistic resistant pad, the warp and weft of the woven sheets within any two adjacent successive groups in the pad are angularly displaced by 45 degrees (as seen in FIGS. 3–5) relative to one another. The angular displacement of the warp and the weft for the successive overlying woven sheets of one group relative to the warp and the weft for the successive overlying woven sheets of an adjacent successive group may selectively range from 22.5 to 45 degrees. Additionally, every other group, for the thirteen to seventeen successive groups, of the Threat Level IIIA ballistic resistant pad, has the warp and the weft for the overlying woven sheets (of every other group) positioned to be aligned with one another.

A method of assembling a ballistic resistant pad is provided. The method of assembling the ballistic resistant pad comprises the steps of positioning at least two woven sheets constructed of high strength fibers in overlying relationship to one another with the warp and the weft of each of the individual woven sheets in substantial alignment with one another forming a first group of overlying sheets, and positioning at least two other woven sheets constructed of high strength fibers in overlying relationship to one another with the warp and weft of each of the individual other woven sheets in substantial alignment with one another forming a second group of overlying sheets. The first and second groups of overlying sheets are placed in overlying relationship with one another such that the warp and the weft of the individual woven sheets of the first group are angularly displaced relative to the warp and the weft of the individual sheets of the second group.

The method selectively includes the step of providing a third group of at least two woven overlying sheets constructed of high strength fibers in which the warp and the weft of the woven overlying sheets of the third group are substantially in alignment with one another. The third group of overlying sheets is placed to overlie the second group of overlying sheets. The step of orienting the warp and the weft of the woven sheets of the third group in angular displacement relative to the warp and weft of the woven sheets of the second group is then performed. The warp and the weft of the overlying sheets of the third group are oriented to be in substantial alignment with the warp and the weft of the overlying sheets of the first group. The step of stacking at least four groups each having at least two woven overlying sheets is selectively performed. The warps and the wefts for the woven sheets of the at the at least four groups are positioned to be angularly displaced relative to the respective warps and wefts for the woven sheets of adjacent ones of the four or more groups.

In preparing the ballistic resistant pad 10, the groups 20A–N of multiple woven sheets 22A, 22B, 24A, 24B, 26A, 26B, 28A, 28B are positioned adjacent to one another. The multiple woven sheets in the groups 20A–N of the pad 10 are selectively woven in a plain weave. The high strength fibers 30, 32, 36, 38, 42, 44 of the woven sheets of the pad selectively provided may be either poly(p-phenylene-2, 6-benzobisoxazole) (PBO) fibers or poly(phenylene-terephthalamide) aramid fibers. The step of orienting the warp fibers and the weft fibers of one group to be angularly displaced ranging from 22.5 to 45 degrees relative to the warp fibers and the weft fibers of another group is performed. For instance, the warp 36 and weft 38 of the woven sheets 24A, 24B of group 20B are oriented to be angularly displaced (at 45 degrees) relative to the warp 30 and weft 32 of the woven sheets 22A, 22B for group 20A. Additionally, the warp 42 and weft 44 of the woven sheets 26A, 26B of group 20C are oriented to be angularly displaced relative to the warp 36 and the weft 38 of the woven sheets 24A, 24B for group 20B. The step of placing the warps and the wefts of the successive overlying woven sheets of every other group of the pad to be substantially in alignment with one another may selectively be performed. The angular displacement of the warp and the weft for woven sheets of one group many selectively range from 22.5 to 45 degrees relative to the respective warp and weft in the woven sheets for the next adjacent successive group in the pad. In different embodiments, two or more none adjacent groups of multiple sheets may have their respective warps and wefts aligned with one another or alternatively, all the groups of multiple sheets may selectively have their respective warps and wefts angularly displaced from one another.

The steps of stitching all of the groups 20A–N of woven sheets 22A–28B together with rows of stitches 14 generally aligned in one direction and also stitching the woven sheets with rows of stitches 16 generally aligned in another crossing direction to form a quilt stitch pattern 18 is performed. The step of stitching the groups of woven sheets together with rows of stitches aligned in one direction and rows of stitches aligned in another direction to form a box stitch pattern may also be performed. The step of enclosing the groups 20A–N of multiple woven sheets 22A–28B into a pad cover 12 constructed at least in part of waterproof and moisture vapor permeable material is accomplished.

In making the ballistic resistant pad an equal number of successive overlying woven sheets within each group may selectively be employed. For instance, each of the groups may be provided with two successive overlying woven sheets. Each of the groups 20A–N may also selectively be provided with three, four, five or any other suitable equal number of successive overlying sheets.

While a detailed description of the preferred embodiment of the invention has been given, it should be appreciated that many variations can be made thereto without departing from the scope of the invention as set forth in the appended claims.

What is claimed is:

1. A ballistic resistant pad comprising:

a first group of at least two successive overlying woven sheets constructed of high strength fibers, in which a warp and a weft for individual ones of the successive overlying woven sheets of the first group are substantially in alignment to one another; and a second group of at least another two successive overlying woven sheets constructed of high strength fibers, in which a warp and a weft for individual ones of the woven sheets of the second group are substantially in alignment to one another and are angularly displaced from the warp and the weft of the woven sheets of the first group.

2. The ballistic resistant pad of claim 1 in which the first group and the second group have an equal number of successive overlying woven sheets.

3. The ballistic resistant pad of claim 2 in which both the first group and the second group each have two successive overlying woven sheets.

4. The ballistic resistant pad of claim 2 in which both the first group and the second group each have three successive overlying woven sheets.

5. The ballistic resistant pad of claim 2 in which both the first group and the second group each have four successive overlying woven sheets.

6. The ballistic resistant pad of claim 2 in which both the first group and the second group each have five successive overlying woven sheets.

7. The ballistic resistant pad of claim 1 in which the individual successive overlying sheets of the first group and the second group have a weight ranging from 3.0 to 6.0 oz/yd$^2$ and a thickness ranging from 0.005 to 0.011 inches.

8. The ballistic resistant pad of claim 1 in which the first and second groups are positioned adjacent to one another.

9. The ballistic resistant pad of claim 1 in which the angular displacement between the warp and the weft of the successive overlying woven sheets of the first group relative to the warp and the weft of the successive overlying woven sheets of the second group ranges from 22.5 degrees to 45 degrees.

10. The ballistic resistant pad of claim 1 in which the high strength fibers are constructed of at least one of a) poly(p-phenylene-2, 6-benzobisoxazole) (PBO) fiber and b) poly (polypheylene-terephthalamide) aramid fiber.

11. The ballistic resistant pad of claim 1 in which the successive overlying woven sheets of the first group and the successive overlying woven sheets of the second group are all stitched together with rows of stitches generally aligned in one direction and with rows of stitches generally aligned in another direction forming one of a) a quilt stitch pattern and b) a box stitch pattern.

12. The ballistic resistant pad of claim 1 in which the high strength fibers of the woven sheets of the first group and the high strength fibers of the woven sheets of the second group are woven in a plain weave.

13. The ballistic resistant pad of claim 1 including a pad cover constructed at least in part of waterproof and moisture vapor permeable material to cover and enclose the first group of overlying woven sheets and the second group of overlying woven sheets.

14. The ballistic resistant pad of claim 1 in which the pad has an areal density not greater than 0.47 lbs/ft$^2$ and a thickness not greater than 0.13 inches and meets a level of protection under National Institute of Justice Standard 0101.04 for Threat Level IIA.

15. The ballistic resistant pad of claim 14 in which the ballistic pad includes sixteen to twenty-four woven sheets forming eight to twelve successive groups which overlie one another, each group within the eight to twelve successive groups has two successive overlying woven sheets within the group, in which the warp and the weft of each of the two successive overlying woven sheets are substantially in alignment to one another and in which the warp and weft of the overlying woven sheets within any two adjacent successive groups are angularly displaced relative to one another.

16. The ballistic resistant pad of claim 15 in which the angular displacement of the warp and weft of the successive overlying sheets within the first group relative to the warp and weft of the successive overlying sheets within the second group ranges from 22.5 degrees to 45 degrees.

17. The ballistic resistant pad of claim 15 in which the warp and weft of the successive overlying woven sheets of every other group, within the eight to twelve successive groups, are substantially in alignment with one another.

18. The ballistic resistant pad of claim 14 in which the successive overlying sheets of the first group and the second group have a weight ranging from 3.0–3.4 oz/yd$^2$ and a thickness ranging from 0.0055–0.0075 inches.

19. The ballistic resistant pad of claim 1 in which the pad has an areal density not greater than 0.56 lbs/ft$^2$ and a thickness not greater than 0.16 inches and meets a level of protection under National Institute of Justice 0101.04 for Threat Level II.

20. The ballistic resistant pad of claim 19 in which the ballistic pad includes twenty to twenty-eight woven sheets forming ten to fourteen successive groups which overlie one another, each group within the ten to fourteen successive groups has two successive overlying woven sheets within the group, in which the warp and the weft of each of the two successive overlying woven sheets are substantially in alignment to one another and in which the warp and weft of the overlying woven sheets within any two adjacent successive groups are angularly displaced relative to one another.

21. The ballistic resistant pad of claim 20 in which the angular displacement of the warp and weft of the successive overlying sheets within the first group relative to the warp and weft of the successive overlying sheets of the second group ranges from 22.5 degrees to 45 degrees.

22. The ballistic resistant pad of claim 20 in which the warp and the weft of the successive overlying woven sheets of every other group, within the ten to fourteen successive groups, are substantially in alignment with one another.

23. The ballistic resistant pad of claim 19 in which the successive overlying sheets of the first group and the second group have a weight ranging from 3.0–3.4 oz/yd$^2$ and a thickness ranging from 0.0055 to 0.0075 inches.

24. The ballistic resistant pad of claim 1 in which the pad has an areal density not greater than 0.72 lbs/ft$^2$ and a thickness not greater than 0.20 inches and meets a level of protection under National Institute of Justice 0101.04 for Threat Level IIIA.

25. The ballistic resistant pad of claim 24 in which the ballistic pad includes twenty-six to thirty-four woven sheets forming thirteen to seventeen successive groups which overlie one another each group within the thirteen to seventeen successive groups has two successive overlying woven sheets within the group, in which the warp and the weft of each of the two successive overlying woven sheets are substantially in alignment to one another and in which the warp and weft of the overlying woven sheets within any two adjacent successive groups are angularly displaced relative to one another.

26. The ballistic resistant pad of claim 25 in which the angular displacement of the warp and weft of the successive overlying sheets within the first group relative to the warp and weft of the successive overlying sheets of the second group ranges from 22.5 degrees to 45 degrees.

27. The ballistic resistant pad of claim 25 in which the warp and the weft of the successive overlying woven sheets of every other group, within the thirteen to seventeen successive groups, are substantially in alignment with one another.

28. The ballistic resistant pad of claim 24 in which the successive overlying sheets of the first group and the second group have a weight ranging from 3.0 to 3.4 oz/yd$^2$ and a thickness of 0.0055 to 0.0075 inches.

29. The ballistic resistant pad of claim 1 in which the pad has an areal density not greater than 0.47 lbs/ft$^2$ and a thickness not greater than 0.13 inches and meets a level of protection under National Institute of Justice 0101.03 for Threat Level IIA.

30. The ballistic resistant pad of claim 29 in which the ballistic pad includes sixteen to twenty-four woven sheets forming eight to twelve successive groups which overlie one another, each group within the eight to twelve successive groups has two successive overlying woven sheets within the group, in which the warp and the weft of each of the two successive overlying woven sheets are substantially in alignment to one another and in which the warp and weft of the overlying woven sheets within any two adjacent successive groups are angularly displaced relative to one another.

31. The ballistic resistant pad of claim 30 in which the angular displacement of the warp and weft of the successive overlying sheets of the first group relative to the warp and weft of the successive overlying sheets of the second group ranges from 22.5 degrees to 45 degrees out of alignment.

32. The ballistic resistant pad of claim 30 in which the warp and weft of the successive overlying woven sheets of every other group, within the eight to twelve successive groups, are substantially in alignment with one another.

33. The ballistic resistant pad of claim 29 in which the successive overlying sheets of the first group and the second group have a weight ranging from 3.0–3.4 oz/yd$^2$ and a thickness ranging from 0.0055 to 0.0075 inches.

34. The ballistic resistant pad of claim 1 in which the pad has an areal density not greater than 0.56 lbs/ft$^2$ and a thickness not greater than 0.16 inches and meets a level of protection under National Institute of Justice 0101.03 for Threat Level II.

35. The ballistic resistant pad of claim 34 in which the ballistic pad includes twenty to twenty-eight woven sheets forming ten to fourteen successive groups which overlie one another, each group within the ten to fourteen successive groups has two successive overlying woven sheets within the group, in which the warp and the weft of each of the two successive overlying woven sheets are substantially in alignment to one another and in which the warp and weft of the overlying woven sheets within any two adjacent successive groups are angularly displaced relative to one another.

36. The ballistic resistant pad of claim 35 in which the angular displacement of the warp and weft of the successive overlying woven sheets of the first group relative to the warp and weft of the overlying sheets of the second group ranges from 22.5 degrees to 45 degrees out of alignment.

37. The ballistic resistant pad of claim 35 in which the warp and the weft of the successive overlying woven sheets of every other group, within the ten to fourteen successive groups, are substantially in alignment with one another.

38. The ballistic resistant pad of claim 34 in which the successive overlying sheets of the first group and the second group have a weight ranging from 3.0 to 3.4 oz/yd$^2$ and a thickness ranging from 0.0055 to 0.0075 inches.

39. The ballistic resistant pad of claim 1 in which the pad has an areal density not greater than 0.72 lbs/ft$^2$ and a thickness not greater than 0.20 inches and meets a level of protection under National Institute of Justice 0101.03 for Threat Level IIIA.

40. The ballistic resistant pad of claim 39 in which the ballistic pad includes twenty-six to thirty-four woven sheets forming thirteen to seventeen successive groups which overlie one another each group within the thirteen to seventeen successive groups has two successive overlying woven sheets within the group, in which the warp and the weft of each of the two successive overlying woven sheets are substantially in alignment to one another and in which the warp and weft of the overlying woven sheets within any two adjacent successive groups are angularly displaced relative to one another.

41. The ballistic resistant pad of claim 40 in which the angular displacement of the warp and weft of successive overlying woven sheets of the first group relative to the warp and the weft of the overlying sheets of the second group ranges from 22.5 degrees to 45 degrees out of alignment.

42. The ballistic resistant pad of claim 40 in which the warp and the weft of the successive overlying woven sheets of every other group, within the thirteen to seventeen successive groups, are substantially in alignment with one another.

43. The ballistic resistant pad of claim 39 in which the successive overlying sheets of the first group and the second group have a weight ranging from 3.0 to 3.4 oz/yd$^2$ and a thickness ranging from 0.0055 to 0.0075 inches.

44. The ballistic resistant pad of claim 1 including a third group positioned adjacent to the second group in which the third group has at least two successive overlying woven sheets in which the weave is constructed of high strength fibers and has a warp and a weft, in which the warp and the weft for individual ones of the woven sheets of the third group are substantially in alignment to one another and are angularly displaced relative to the warp and the weft of the woven sheets of the second group.

45. The ballistic resistant pad of claim 44 in which the warp and the weft of the overlying woven sheets within the third group are substantially in alignment with the warp and the weft of the overlying woven sheets within the first group.

46. The ballistic resistant pad of claim 44 in which the first group, the second group and the third group have an equal number of successive overlying woven sheets.

47. A method for assembling a ballistic resistant pad comprising the steps of:

positioning at least two woven sheets constructed of high strength fibers in overlying relationship to one another with a warp and a weft of each of the individual woven sheets in substantial alignment with one another forming a first group of overlying sheets;

positioning at least two other woven sheets constructed of high strength fibers in overlying relationship to one another with a warp and a weft of each of the individual other woven sheets in substantial alignment with one another forming a second group of overlying sheets; and placing the first and second groups of overlying sheets in overlying relationship with one another such that the warp and weft of the individual woven sheets of the first group are angularly displaced relative to the warp and weft of the individual sheets of the second group.

48. The method of assembling of claim 47 in which the step of positioning at least two woven sheets includes the step of providing two woven sheets, and the step of positioning at least two other sheets includes the step of providing two woven sheets.

49. The method of assembling of claim 47 in which the step of positioning at least two woven sheets includes the step of providing three woven sheets, and the step of positioning at least two other sheets includes the step of providing three woven sheets.

50. The method of assembling of claim 47 in which the step of positioning at least two woven sheets includes the step of providing four woven sheets, and the step of positioning at least two other sheets includes the step of providing four woven sheets.

51. The method of assembling of claim 47 in which the step of positioning at least two woven sheets includes the step of providing five woven sheets, and the step of positioning at least two other sheets includes the step of providing five woven sheets.

52. The method of claim 47 in which the step placing includes the step of positioning the first and second groups adjacent to one another.

53. The method of assembling of claim 47 in which the step of placing the first and second groups includes the step of orienting the warp and weft of the first group angularly displaced in a range of 22.5 to 45 degrees relative to the warp and weft of the second group.

54. The method of assembling of claim 47 including the step of providing the high strength fibers to be at least one of a) poly(p-phenylene-2, 6-benzosoxazole) (PBO) fiber and b) poly(polyphenylene-terephthalamide) aramid fiber.

55. The method of assembling of claim 47 including the step of stitching the first and second groups together with rows of stitches generally aligned in one direction and with rows of stitches generally aligned in another direction forming one of a) a quilt stitch pattern and b) a box stitch pattern.

56. The method of assembling of claim 47 including the step of providing the at least two woven sheets and the at least two other woven sheets in a plain weave.

57. The method of assembling of claim 47 including the step of enclosing the first and second groups into a pad cover constructed at least in part of waterproof and moisture permeable material.

58. The method of assembling of claim 47 including the step of providing a third group of at least two woven overlying sheets constructed of high strength fibers in which the warp and the weft of the woven overlying sheets of the third group are substantially in alignment with one another.

59. The method of assembling of claim 58 including the step of placing the third group of overlying sheets to overlie the second group of overlying sheets, and orienting the warp and weft of the woven sheets of the third group in angular displacement relative to the warp and weft of the woven sheets of the second group.

60. The method of assembling of claim 59 including the step of orienting the warp and weft of the overlying sheets of the third group in substantial alignment with the warp and weft of the overlying sheets with the first group.

61. The method of assembling of claim 58 including the step of providing an equal number of successive overlying woven sheets within each of the first, second and third groups.

62. The method of assembling of claim 58 including the step of placing the warp and the weft of the successive overlying woven sheets of every other group of the pad to be substantially in alignment with one another.

63. The method of assembling of claim 58 including the step of stacking at least four groups each having at least two woven overlying sheets.

64. The method of assembling of claim 47 including the steps of stacking at least four groups each having at least two woven overlying sheets; and positioning the warps and wefts for the woven sheets of the at least four groups to be angularly displaced relative to the respective warps and wefts for the woven sheets of adjacent groups of the at least four groups.

* * * * *

UNITED STATES PATENT AND TRADEMARK OFFICE

CERTIFICATE OF CORRECTION

PATENT NO. : 6,559,079 B1
DATED : May 6, 2003
INVENTOR(S) : Thomas E. Bachner, Jr.

It is certified that error appears in the above-identified patent and that said Letters Patent is hereby corrected as shown below:

Drawings,
Replace Figs 1-5 with attached Figs. 1-5 now on replacement drawing sheets 1 and 2.

Signed and Sealed this

Twenty-eighth Day of October, 2003

JAMES E. ROGAN
*Director of the United States Patent and Trademark Office*